United States Patent [19]

Hycner et al.

[11] Patent Number: 4,862,799

[45] Date of Patent: Sep. 5, 1989

[54] COPPER COATED ANODIZED ALUMINUM INK METERING ROLLER

[75] Inventors: Stanley H. Hycner, Bartlett; Thomas A. Fadner, LaGrange; Shem-Mong Chou, Westmont, all of Ill.

[73] Assignee: Rockwell International Corporation, Pittsburgh, Pa.

[21] Appl. No.: 282,160

[22] Filed: Dec. 9, 1988

Related U.S. Application Data

[63] Continuation of Ser. No. 120,274, Nov. 13, 1987, abandoned.

[51] Int. Cl.[4] ..... B41F 31/26

[52] U.S. Cl. ..... 101/348; 29/132; 204/25; 204/38.3

[58] Field of Search ..... 101/348, 401.1, 349, 101/148, 350, 150, 170, 395; 29/132; 204/38.3, 25

[56] References Cited

U.S. PATENT DOCUMENTS

| | | | |
|---|---|---|---|
| 3,929,594 | 12/1975 | Fromson | 101/456 X |
| 4,431,707 | 2/1984 | Burns et al. | 204/38.3 X |
| 4,537,127 | 8/1985 | Fadner et al. | 101/141 |
| 4,567,827 | 2/1986 | Fadner | 101/150 X |
| 4,601,242 | 7/1986 | Fadner | 101/348 |
| 4,637,310 | 1/1987 | Sato et al. | 101/348 X |
| 4,690,055 | 9/1987 | Fadner et al. | 101/148 X |

FOREIGN PATENT DOCUMENTS

| | | | |
|---|---|---|---|
| 0056855 | 4/1983 | Japan | 101/348 |
| 1585143 | 2/1981 | United Kingdom | 101/348 |

*Primary Examiner*—Clifford D. Crowder

[57] ABSTRACT

An ink metering roller of an engraved aluminum base having a substantially continuous anodized surface layer of aluminum oxide ranging from about 1 to 3 microns in thickness and a layer of copper plate deposited directly onto the anodized surface.

4 Claims, 2 Drawing Sheets

COPPER COATED ANODIZED ALUMINUM INK METERING ROLLER

This application is a continuation, of application Ser. No. 120,274, filed 11/13/87, now abandoned.

BACKGROUND OF THE INVENTION

In the art and practice of keyless lithographic printing, an integral and important means for controlling the input of ink to the inking rollers of the printing press involves the use of a celled metering roller. Sequential and continuous means are generally supplied to first overfill the well-defined cells in the surface of the metering roller with fresh incoming ink. A scraping or doctor blade is provided to remove virtually all of this excess ink form the metering roller excepting that residing in the cells and the ink-filled cells then transfer a known quantity of ink to an appropriate set of coextensive inking rollers. The inking rolls in turn convey the ink as a more-or-less uniform film to the image areas of the printing plate, thence to the printing blanket, and then to the paper or other substrate being printed in a form corresponding to the image areas of the printing plate. The inking rollers also serve to return that portion of the incoming ink not required to refresh the printing plate image format to a location in the inking system where it is continuously removed and returned to the input portion of the inking system for reuse. Conventional lithographic inking systems do not utilize the removal and reuse components characteristic of keyless inking.

In the practice of lithographic printing it is essential to maintain sufficient water in the non-image areas of the printing plate to assure. that image/non-image differentiation is maintained. This is to assure that ink will transfer only to the image portions of the printing plate format. Many different dampening or water conveying systems have been devised and these systems may be referred to by consulting "An Engineering Analysis of the Lithographic Printing Process" published by J. MacPhee in the Graphic Arts Monthly, November, 1979, pages 666–68, 672–73. Neither the nature of the dampening system nor the nature of the dampening materials that are routinely used in the practice of high speed lithography are expected to place restrictions on utilizing the teachings conveyed in this disclosure.

Reference to R. W. Bassemir or to T. A. Fadner in "Colloids and Surfaces in Reprographic Technology", published by the American Chemical Society in 1982 as ACS Symposium Series 200, will relate that in the art of lithography the inks must be able to assimilate or take up a quantity of water for the lithographic process to have practical operational latitude. Apparently the ink acts as a reservoir for spurious quantities of water that may appear in inked image areas of the plate, since water is continuously being forced onto and into the ink in the pressure areas formed at the nip junction of inking rollers, dampening system rollers, and printing plates of the printing press. Whatever the mechanism might be, all successful lithographic inks when sampled from the inking system rollers are found to contain from about one percent to about as high as 50 percent of water, more or less, within and after a few revolutions to several thousand revolutions after start-up of the printing press. During operation of the press, some of the inking rollers must unavoidably encounter surfaces containing water, such as the printing plate, from which contact a more or less gradual buildup of water in the ink takes place, proceeding eventually back through the inking train, often all the way to the ink reservoir. Consequently, the presence of water in the ink during lithographic printing is a common and expected occurrence.

The first essential property for successful operation of a celled metering roller in keyless lithographic printing is the capability of forming and retaining correctly-dimensioned cells in the surface of the roller during manufacturing. This allows a known amount of ink to be delivered to the inking roller of the press. The technology and art of selecting cell patterns, cell geometry, percentage of non-celled area termed lands or land area, and the like are well-known in the practice of printing with celled roller inkers. It is equally well-known that the three practical means for forming cells in an appropriate metering roller surface are mechanical engraving or knurling or embossing, diamond-stylus engraving or gouging or cutting, and laser engraving or energetic blasting of holes in the roller's surface. One or another of the desired cell patterns and one of these three means for forming the cells are selected depending upon the materials' properties and the materials' requirements for the printing process under consideration.

Cells must be accurately formed in the roller's surface and except when using the more-expensive and less-practiced laser-engraving process with which virtually any practical material can be engraved regardless of hardness, formation of the cells requires that the base roller surface be deformable by, for instance, hardened steel knurling tools. Unhardened steel has been the nearly universal material of choice in prior art celled metering roller technologies. Steel alloys can be selected with appropriate bulk strength, machinability to form the blank roller cylinder, and embossability to form accurate cells.

A second requirement for a celled ink metering roller is resistance to wear erosion of the roller surface and therefore of the cells themselves caused by the scraping blade and by any inking rollers that may be running in physical interference with the metering roller. Generally, this requirement translates into a hardness value of about Rockwell 70 or higher on the C scale. Prior art technologies have utilized chromium plated over copper, nitriding of the steel surface, and flame-sprayed ceramic coatings such as chromium oxide, aluminum oxide or tungsten carbide. Achieving this hardness quality minimizes how often the metering roller must be replaced due to wear in order to maintain consistent day-to-day ink delivery performance of the keyless printing press system.

Previous disclosures have shown that the surface of a metering roller to be used in the lithographic printing process must not only meet the first and second requirements but also must be oleophilic, or oil-loving, and hydrophobic, or water-repelling. This means that when both an oil-based lithographic ink and the dampening water are present at the metering roller's surface, the roller will tend to retain the ink rather than the water on and in its surface and thereby continue to function as an ink metering roller despite the presence of the water. None of the hard materials commonly used in flexographic, letterpress or gravure printing are suitable for use in lithography since they are all hydrophilic.

Although these four just-described propertes are necessary to the formation of an ink metering roller intended for use in keyless lithographic printing, prior art metering roller technologies that meet these criteria may suffer from one or more disadvantages when put to practical use in hard-running printing pressroom environments.

One disadvantage of the prior art technologies utilizing a steel base roller material is their weight, typically from about 150 pounds for a 36-inch long roller to about 400 pounds for a 72 inch-wide printing press. Handling these heavy rollers in the pressroom either to install or replace them requires special fixtures and skills. Light weight metering rollers would represent a distinct practical advantage.

Another disadvantage of all metering roller technologies using a steel base roller is that the steel is subject to oxidative corrosion by diffusion of atmospheric water vapor, dampening water, or any spurious water to the steel surface during manufacture, or shipping, or storage or while in use as a lithographic ink meter roller. Corrosion of the steel surface can totally disbond the coatings that may have been applied during manufacture to render the roller surface hard and wear resistant. As pointed out in British Patent 1,585,413, subsequent use of a coated but corroded roller in the intended operating mode running against a scraping doctor blade may totally remove the coating that was originally intended to impart superior wear resistance. Thus, flame-sprayed ceramic coatings applied over a steel base roller are naturally hydrophilic and porous and therefore require treatment for instance with an adherent water-impermeable organic polymeric material that functions to seal the ceramic layer pores thereby protecting against diffusion of water through the ceramic to the steel core.

Another means for avoiding the effect of corrosion on a steel-based metering roller is to chemically render the steel surface simultaneously hard and corrosion resistant, for instance by nitriding the steel as disclosed by Fadner et al in U.S. Pat. No. 4,537,127 and by Sato et al in U.S. Pat. No. 4,637,310. Chemical conversion of the steel surface to an iron nitride results in a hard surface layer that remains an integral part of the base steel roller and unlike the sharp boundary typical of an applied coating, has a naturally stronger diffuse or gradual boundary leading from the bulk steel to the hard nitrided surface layer. This property together with the higher inherent resistance of nitrided steel to oxidative corrosion appropriately renders the surface of the base steel alloy both wear and corrosion resistant. Rollers based on nitriding technology require prior mechanical engraving of the unhardened steel surface. Both these prior art technologies necessarily result in heavy finished meter rollers. Both also rely on use only of mechanical engraving to form the cells.

Fadner in U.S. Pat. No. 4,601,242 discloses means for rendering the surface of a celled base roller hard and oleophilic and hydrophobic by applying a thin copper coating to the celled base roller followed by a thin porous flame-sprayed ceramic coating such as alumina over the copper. The copper layer serves to protect or seal the steel from spurious corrosion due to the omnipresent water and presents an oleophilic and hydrophobic surface upon which to anchor the oily lithographic ink despite the presence of water once the ink has migrated through the thin, porous ceramic coating. Thus the outermost surface of the roller is celled because of the thinly applied coatings, hard because of the last applied ceramic material and once filled with ink functions as an oleophilic and hydrophobic surface for the subsequent metering of ink on press. This technology is also limited to the art of mechanical engraving to form the cells and by stated example involves use of a heavy steel base roller material. This technology involves application of two distinct material layers and therefore has two interfacial boundaries, steel to copper and copper to ceramic, both of which could fail because of chemical or mechanical stresses imposed during manufacture or during use on a printing press.

In yet another approach, Fadner in 4,567,827 avoids the perceived wear and corrosion disadvantages of uncoated engraved steel rollers by first applying to a suitably engraved base roller a hardenable electroless nickel layer, heating the roller to harden the nickel, then applying a thin copper layer on the nickel to supply the required oleophilic and hydrophobic properties. In this technology any suitable base roller material such as a steel or aluminum alloy may be used Fadner has disclosed that at least some of the copper stays in place on the nickel during doctor blade scraping for up to 40 million printing impressions. It must however eventually wear off of the relatively smooth nickel base coating, exposing the oleophilic but hydrophilic nickel layer, producing roller failure because the roller can no longer pick up ink in the presence of both ink and water. Additionally, this technology also has two interfaces that can potentially fail because of chemical and/or mechanical stresses, namely steel to nickel and nickel to copper.

A particular disadvantage in using a steel base roller to fabricate any celled metering roller for use in lithographic printing press systems is that the required cells cannot be formed by means of diamond-stylus technology. Though embossable, as by hardened mechanical engraving tools, steel alloys are too hard for practical, repetitive cutting by the diamond-stylus technique. Thus, otherwise advantageous and relatively operator-independent, electronically-controlled diamond stylus techniques such as represented by Hell Helioklishograph and American Engraving and Machine Co., which are well-developed for use in cutting cells in softer metals such as copper for manufacture of rotogravure printing cylinders, are precluded form use in manufacture of most prior art ink metering rollers for keyless lithography.

There exists a need for light-weight, easily handled celled ink metering rollers in keyless lithographic printing systems that require a minimum number of failure-prone add-on coatings to render the roller hard, oleophilic and hydrophobic.

SUMMARY OF THE INVENTION

This invention relates to method, materials and apparatus for metering ink in modern, high-speed, keyless, celled metering roller, lithographic printing press systems, wherein means are provided to make and use novel and advantageous celled metering rollers required in the operation of said systems.

In these keyless lithographic printing systems the amount of ink reaching the printing plate is typically controlled primarily by the dimensions of depressions or cells in the surface of a metering roller and by a coextensive scraping or doctor blade that continuously removes virtually all the ink from the celled metering roller except that carried in the cells or recesses.

The ink metering roller of this invention is composed of an aluminum core of suitable length and diameter, engraved or otherwise manufactured to have accurately-dimensioned and positioned cells or recesses in its face surface and lands or bearing regions which comprise all the roller's face surface excepting that occupied by cells, which cells together with a scraping doctor blade serve to precisely meter a required volume of ink. To assure economically acceptable metering roller lifetimes, without serious deviation of the metering roller's ink volume control function, the metering roller core is anodized to form a hard oxidized face layer. The anodized roller is then coated with an adherent, hyrophobic and oleophilic material layer, preferably composed substantially of copper.

A primary objective of this invention is to provide an improved and inexpensive manufacturing method and roller made therefrom that ensures the economically practical operation of a simple system for continuously conveying ink to the printing plate in keyless lithographic printing press systems.

Another object of this invention is to provide a lightweight metering roller with a surface that is sufficiently hard and wear-resistant to allow long celled-roller lifetimes despite the scraping, wearing action of a doctor blade and of inking rollers substantially in contact with it.

Another object of this invention is to provide material means whereby electronically controlled stylus engraving can be used to make celled rollers for keyless lithographic printing presses.

Yet another object of this invention is to provide material and method for assuring that aqueous lithographic dampening solutions and their admixtures with lithographic inks do not interfere with the capability of a celled ink-metering roller to continuously and repeatedly pick-up and transfer precise quantities of ink.

A still further object of this invention is to provide an improved light weight inking roll having a composite structure that combines high degrees of ink attraction and ink retention with a long wearing surface.

These and other objects and advantages of this invention will, in part become obvious and in part be explained by reference to the accompanying specification and drawings, in which:

DESCRIPTION OF THE PREFERRED EMBODIMENT

Figure 1:
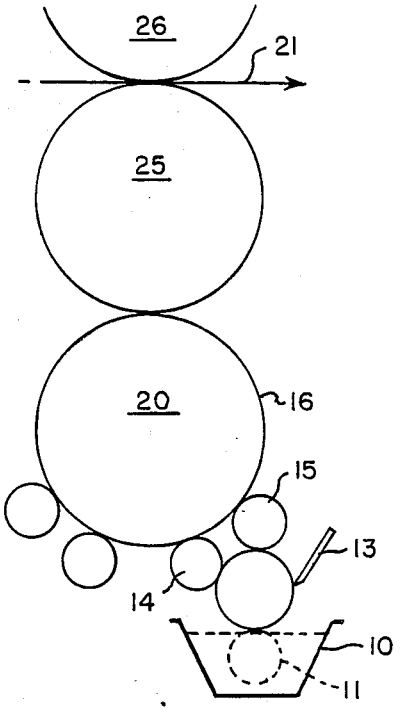
FIG. 1 is a schematic end elevation of one preferred application of the inking roll of this invention.
Figure 2:
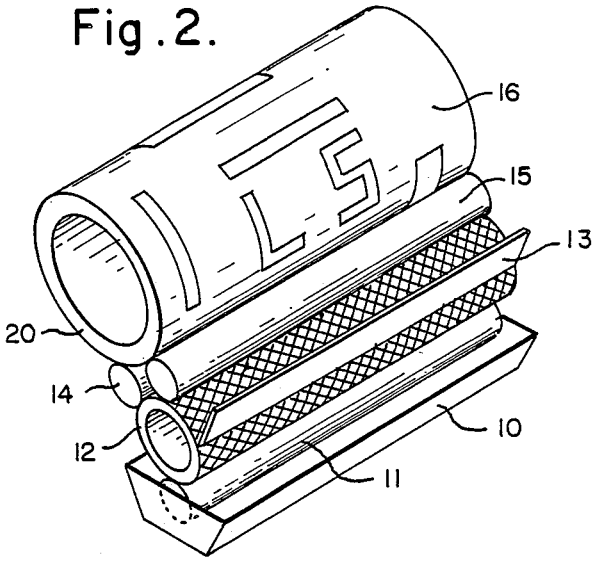
FIG. 2 is a perspective view of the combined elements of FIG. 1.
Figure 3:
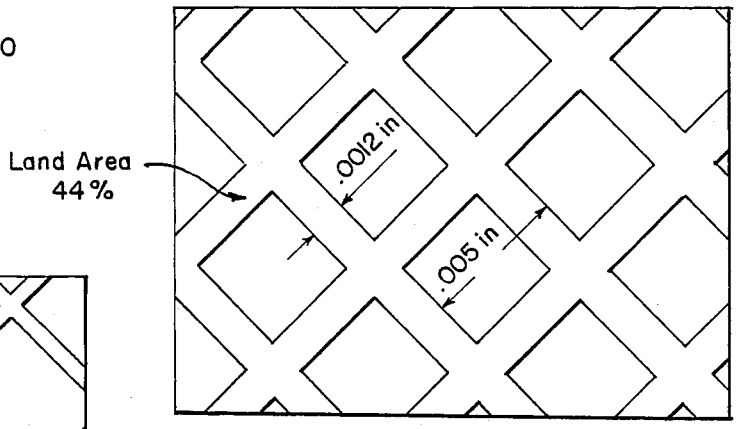
FIG. 3 is a schematic showing a cell pattern which may be used in this invention.
Figure 4:
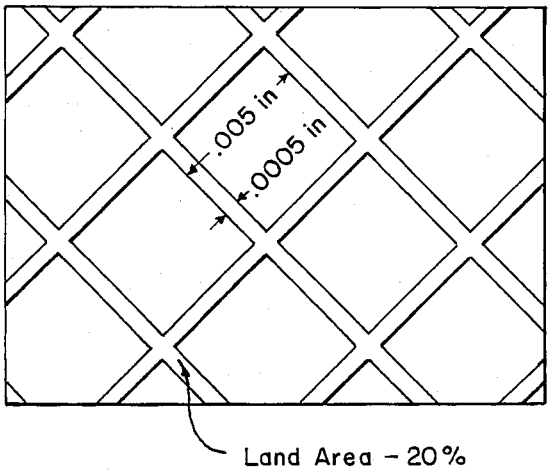
FIG. 4 is an alternative cell pattern.
Figure 5:
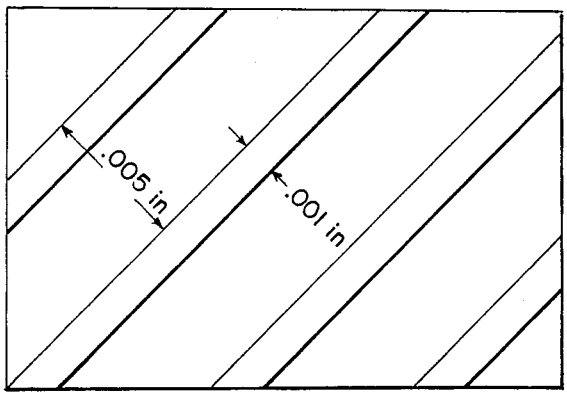
FIG. 5 is another alternative cell pattern that can be advantageously used with this invention.
Figure 6:
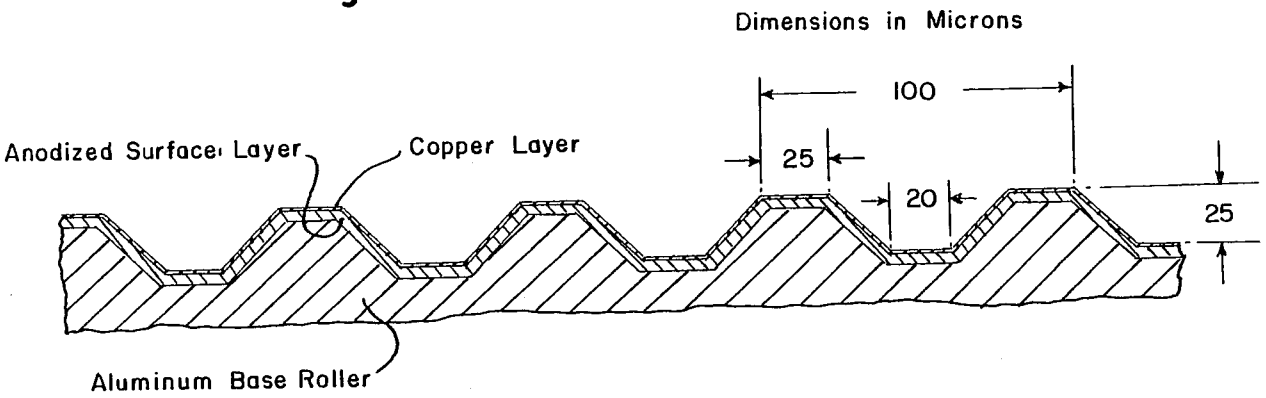
FIG. 6 is a schematic magnified view showing the celled roller having a copper layer over the celled anodized aluminum base roller.

Referring to FIGS. 1 and 2, an inker configuration suited to the practice of this invention in offset lithography consists of an ink-reservoir or ink-fountain 10 and a driven ink-fountain roller 11, a press-driven oleophilic/-hydrophobic engraved or cellular roller 12, a reverse-angle metering blade or doctor-blade 13, and friction driven form rollers 14 and 15, which supply ink to a printing plate 16 mounted on plate-cylinder 20 and this in turn supplies ink to for example a paper web 21 being fed through the printing nip formed by the blanket cylinder 25 and the impression cylinder 26. All of the rollers in FIGS. 1 and 2 are configured substantially parallel axially.

The celled metering roller 12 of FIGS. 1 through 5 is the novel element of this invention. It consists of mechanically engraved or diamond-stylus engraved or otherwise-formed, patterned cells or depressions in the face surface of an aluminum roller, the volume and frequency of the depressions being selected based on the volume of ink needed to meet required printed optical density specifications. The nature of this special roller is made clear elsewhere in this disclosure and additionally in part, in FIGS. 3, 4 and 5 which depict suitable alternative patterns and cross-sections. Generally the celled metering roller will eb rotated by a suitable driving mechanism at the same speed as the printing cylinders 20, 25 and 26 of FIG. 1, typically from about 500 to 2000 revolutions per minute.

The doctor blade 13 depicted schematically in FIG. 1 and in perspective in FIG. 2 is typically made of flexible spring steel about 6 to 10 mils thick, with a chamferred edge to better facilitate precise ink removal. Mounting of the blade relative to the special metering roller is critical to successful practice of this invention but does not constitute a claim herein since doctor blade mounting techniques suitable for the practice of this invention are well known. The doctor blade or the celled metering roller may be vibrated axially during operation to distribute the wear patterns and achieve addiitional ink film uniformity.

Typically, differently-diametered form-rollers 14 and 15 of FIG. 1 are preferred in inking systems to help reduce ghosting in the printed images. These rollers will generally be a resiliantly-covered composite of some kind, typically having a Shore A hardness value between about 22 and 28. The form rollers preferably are mutually independently adjustable to the printing plate cylinder 20 and to the special metering roller 12 of this invention, and pivotally mounted about the metering roller and fitted with manual or automatic trip-off mechanisms as is well known in the art of printing press design. The form rollers are typically and advantageously friction driven by the plate cylinder 20 and/or metering roller 12.

Disclosures in U.S. Pat. No. 4,537,217 and U.S. Pat. No. 4,601,242 point out the necessity for lithographic keyless inking rollers to be hard, oleophilic and hydrophobic. All prior art disclosures known to us utilize solid or pipe steel rollers, the steel alloy being selected based on whether or not the roller surface is to be chemically treated as by nitriding. Non-nitriding steel grades are less expensive and all but the hardest and most brittle of the available steel alloys can be mechanically engraved although none can be electronically engraved as by means of diamond stylus devices referred to earlier in this disclosure.

Also noted elsewhere in this disclosure steel when used as the base roller material is subject to the deleterious corrosive influences of shipping, pressroom and dampening solution environments. Steel rollers can weigh much more than one man can conveniently or safely handle even with mechanical lifting devices.

We have found that a surface-hardened engraved aluminum solid or pipe roller when overcoated with a thin copper coating will function to supply all of the necessary primary attributes for use in keyless lithographic ink-metering systems, namely engravability of the unhardened aluminum for accurate cell formation, surface hardness for wear resistance, oleophilic or oilink loving and hydrophobic or water-shedding. Additionally, the metering rollers made according to this invention are strong enough to withstand the mechanical forces when positioned in the keyless printing press system yet sufficiently light weight to readily accomplish installation to and removal from the press with less auxiliary equipment and less manual labor than heavy steel counterparts of the prior art. Typically aluminum rollers will weigh only about 50 to 135 pounds.

In the practice of our invention, one may select for the base roller material one of the many aluminum alloys that are readily anodized, such as grades designated 2021, 6061 or 7075. Generally these will be aluminum alloys that have a suitable combination of mechanical strength, workability for engraving, and anodizability for hardening.

When selecting an aluminum alloy base material to be diamond stylus engraved we prefer to select the softer of the anodizeable alloys such as 2021 and 6067, thereby prolonging the life of the engraving stylus and ensuring greater accuracy of the engraving operation.

Prior to anodizing, the base material is turned to a near net cylindrical shape then subjected to mechanical engraving or diamond stylus engraving to form the preselected cell pattern in the roller's surface. Laser engraving of the aluminum roller may be employed but is more expensive and forms smaller-diameter cells or holes in the surface. Surface growth subsequent anodizing would have a large negative effect on the cell carrying capacity partially negating the original intention of the engravature.

The engraved aluminum base roller i s then subjected to one of the many well-known, often proprietary, anodizing operations to form a relatively rough, porous and hard oxide layer at and within the aluminum surface generally ranging from about one to three microns in depth. Generally, during anodizing, about half of the anodized layer thickness formed corresponds to regions where the aluminum has been chemically eroded away from the surface and half of the layer thickness is formed by re-deposition of eroded aluminum and by uptake of oxygen to form the oxide. In any case, a coating of surface hardness above about 70 on a Rockwell Hardness C scale can readily be formed, yet retain the basic dimensional integrity of the previosly engraved cells.

The anodized aluminum surfaces are known to be both hydrophilic and oleophilic. Either ink or water will wet the surface and adhere thereto. In the presence of both oil and water, however, water will sooner or later displace or disbond oil and will also disbond lithographic ink from an anodized aluminum surface. This property explains why anodized aluminum sheet stock has become the standard for manufacture of lithographic printing plates. For the same reason, the roller at this stage of manufacture is not suitable for metering inks in keyless lithographic printing systems.

As previously disclosed by Fadner in U.S. Pat. No. 4,537,127, copper is an ideal oleophilic and hydrophobic material once it has been exposed to normal atmospheric environments. According to our invention, a thin layer of copper is applied to an anodized engraved aluminum base roller either by electrolytic or electroless or vacuum deposition. Surprisingly, instead of the doctor blade rapidly striping off or wearing off the copper layer, the resulting metering roller functions as if it was composed of a single hard, oleophilic and hydrophobic material.

Although not completely understood, most or nearly all of the applied copper layer remains in place during millions of printing impressions despite an expected eroding effect due to the doctor blade scraping against the roller surface. This is an advantageous attribute since a practical metering roller must not only resist erosion of the hard surface but must resist removal of the oleophilic and hydrophobic elements, in this case copper, to continue conveying ink in the presence of water. We believe that the unexpectedly advantageous adherence of copper to the anodized aluminum surface is due to the microporosity of the upper portions of the anodized layer. This not only provides a large surface area that enhances adhesion but also may provide minute hard aluminum oxide protrusions that extend through the copper layer which function to support the coextensive doctor blade and inking rollers, between which are valleys or interstices or pockets of copper which function to maintain the overall surface of the roller oleophilic and hydrophobic.

Having set down the principles and concepts of our invention, a specific example will illustrate its elements.

A 36-inch face length 4.42 inch diameter 6061T6 aluminum alloy roller was mechanically engraved by Pamarco, Inc., Roselle, N.J. using a standard 250 lines/inch, truncated quadrangular engraving tool, resulting in a patterned, celled roller face configuration similar to FIG. 2. The engraved roller was subsequently hardface processed by Webex, Inc. using a proprietary process involving in sequence (1) vapor degreasing with a cleaning solvent, (2) pretreatment dip in a nitric acid bath, (3) hardcoating treatment in a 100° F. chromic acid bath for 30 minutes at 30–50 volts DC relative to ground, (4) rinsing with deionized water, (5) sealing treatment in a deionized water bath for 30 minutes at 200° F., and (5) air drying to remove residual moisture. The treatment results in a hard anodized engraved surface coating about 2 microns. thick during which the roller radius increased more-or-less uniformly by about one micron. The engraved hardfaced celled roller was then cyanide copper electroplated by Krel Laboratories to produce a nominally uniform 0.0003 in. copper layer on the roller's outermost surface. The roller was then fitted into the metering roller position of a keyless printing press configured similar to the FIG. 1 illustration and used for printing 40,000 copies of typical format to demonstrate excellent ink carrying properties despite the presence of dampening water. The roller was subsequently transferred to a non-printing but o therwise similar doctor blade scraping device and rotated first for ten million equivalent printing impressions, then removed to the printing press for print testing, then onto the wear device for another ten million impressions, and again print tested. All three print tests appeared virtually identical. The roller exhibited excellent keyless inking printing results and no measureable wear nor loss of outermost copper layer.

Although the present invention has been described in connection with preferred embodiments, it is to be understood that modifications and variations may be resorted to without departing from the spirit and scope of the invention as those skilled in the art will readily understand. Such modifications and variations are considered to be within the purview and scope of the invention and the appended claims.

We claim:

1. An ink metering roller for use in keyless lithographic printing consisting essentially of:

(a) an engraved aluminum base roller of suitable diameter and length having a substantially continuous anodized outer surface layer of aluminum oxide ranging from about 1 to 3 microns in thickness and having a hardness of at least about 70 $R_c$; and (b) a layer of copper plate deposited directly onto said continuous, anodized layer of aluminum oxide.

2. An ink metering roller as defined in claim 1 wherein said anodized outer surface layer consists of porous aluminum oxide.

3. An inking system for use in lithographic printing comprising a plurality of coacting inking rollers, one of said inking rollers being an ink metering roller comprising:

a. an engraved aluminum base roller of suitable diameter and length having a substantially continuous anodized outer surface layer of aluminum oxide ranging from about 1 to 3 microns in thickness having a hardness of at least about 70 $R_C$; and a layer of copper plate deposeted directly onto said anodized layer of aluminum oxide.

4. A process for producing an ink-metering roller for use in keyless lithographic printing comprising:

a. providing an aluminum base roller of suitable diameter and length which has an engraved outer surface;

b. anodizing the engraved outer surface to form a substantially continuous hard, porous aluminum oxide layer ranging from about 1 to 3 microns in thickness; and c. depositing a layer of copper directly onto the oxide layer on the outer surface.

* * * * *